US006626711B2

(12) United States Patent
Kitagawa et al.

(10) Patent No.: US 6,626,711 B2
(45) Date of Patent: Sep. 30, 2003

(54) PRESS-CLAMPING TERMINAL AND METHOD OF EXAMINING PRESS-CLAMPED CONDITION THEREOF

(75) Inventors: Hironori Kitagawa, Shizuoka (JP); Naoki Ito, Shizuoka (JP); Tsutomu Takayama, Shizuoka (JP); Toshihiro Maki, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/876,147

(22) Filed: Jun. 8, 2001

(65) Prior Publication Data

US 2002/0022414 A1 Feb. 21, 2002

(30) Foreign Application Priority Data

Jun. 12, 2000 (JP) ..... P. 2000-175731
Jun. 12, 2000 (JP) ..... P. 2000-175732

(51) Int. Cl.[7] ..... H01R 4/10
(52) U.S. Cl. ..... 439/877
(58) Field of Search ..... 439/877, 878, 439/874, 880, 881, 882; 29/857, 863, 864, 865, 866, 867

(56) References Cited

U.S. PATENT DOCUMENTS 2,992,404 A * 7/1961 Berg ..... 439/849
4,087,889 A 5/1978 Ohba et al. ..... 24/129 W
4,846,736 A 7/1989 Powers et al. ..... 439/738
6,113,441 A * 9/2000 Fukase et al. ..... 439/877

FOREIGN PATENT DOCUMENTS

GB 1300923 3/1970
GB 1367540 9/1974
JP 11-87010 * 3/1999 ..... H01R/43/048

* cited by examiner

*Primary Examiner*—Ross Gushi
(74) *Attorney, Agent, or Firm*—Morgan, Lewis & Bockius LLP

(57) ABSTRACT

To provide a press-clamping terminal in which a press-clamped condition can be easily examined, an examination mark (14), which can be deformed upon press-deforming of a barrel (11), is impressed on or stamped in an outer surface of a bottom portion (12) of a press-clamping terminal (10). (See FIG. 8.) To provide a press-clamping terminal in which an examination can be easily carried out with the need for using a bulky apparatus and tools, grooves (160), serving as a criterion for confirming a press-clamped condition, are impressed on or stamped in an outer surface of a bottom portion (120) of a barrel (110). Also, a mark (170), indicating a press-clamping position, is formed or impressed in this outer surface. (See FIG. 24.)

9 Claims, 13 Drawing Sheets

PRESS-CLAMPING TERMINAL AND METHOD OF EXAMINING PRESS-CLAMPED CONDITION THEREOF

BACKGROUND OF THE INVENTION

1. Field of the Invention

The present invention relates to a press-clamping terminal (or crimp-type terminal) for press-fastening a sheathed wire in connecting relation thereto by press-clamping, in which whether or not a press-clamped condition is good can be easily confirmed. Further, the present invention also relates to a press-clamping terminal (or crimp-type terminal) for press-clamping a sheathed wire in connecting relation thereto by its bottom portion and press-deforming side piece portions formed respectively at opposite side edges of the bottom portion. Furthermore, the present invention also relates to a method of examining the press-clamped condition of the press-clamping terminal.

The present application is based on Japanese Patent Application Nos. 2000-175731 and 2000-175732, which are incorporated herein by reference.

2. Description of the Related Art

In the processing of the wiring in an electric system for a vehicle or the like, press-clamping terminals, formed by pressing a metal sheet into a predetermined shape, have been used to connect wires together or to connect a wire to an electrical equipment.

FIG. 1 shows such press-clamping terminals formed from a metal sheet. The plurality of press-clamping terminals 1 of a predetermined shape are formed from one metal sheet by a pressing machine (not shown) in such a manner that these terminals 1 are interconnected by a connecting plate 6, each of the press-clamping terminals 1 having a barrel 2 for press-clamping a sheathed wire in connecting relation thereto. The barrel 2 includes a pair of side piece portions 4*a* and 4*b* formed on and extending generally upright respectively from opposite side edges of a bottom portion 3 of the press-clamping terminal 1, and the barrel 2, before press-clamping the sheathed wire, has a generally U-shaped cross-section. In FIG. 1, reference numeral 5 denotes an electrical connection portion for connection to a mating terminal.

The press-clamping terminal 1 is arranged in such a manner that the bottom portion 3 of the barrel 2 is set on an anvil of a pressing apparatus, and then the sheathed wire is inserted into the barrel to be disposed on the inner surface of the bottom portion 3 in the longitudinal direction. Then, a crimper of the pressing apparatus is moved downward to curve the two side piece portions 4*a* and 4*b* of the barrel 2 inwardly in such a manner that the side piece portions 4*a* and 4*b* are opposed to the bottom portion 3, and as a result the bottom portion 3 and the side piece portions 4*a* and 4*b* press-clamp a conductor portion 7 of the sheathed wire in an embracing manner, as shown in FIG. 2.

In a first examination technique of the related art, after the conductor portion 7 is thus press-clamped, an examination is conducted to determine whether or not the press-clamping has been carried out properly. In the first examination technique, the barrel 2 is cut, and the cross-section thereof is observed, and it is judged from its cross-sectional shape whether or not the clamping is good. More specifically, when the two side piece portions 4*a* and 4*b*, press-clamping the conductor portion 7, are disposed symmetrically, this terminal is regarded as a good product.

On the other hand, when it is confirmed that the right side piece portion 4*b* extends into the conductor portion 7 as shown in FIG. 3A, or the left side piece portion 4*a* extends into the conductor portion 7 as shown in FIG. 3B, so that the two side piece portions are not disposed symmetrically, and therefore either of the two side piece portions is shifted or deviated from the proper press-clamping position (This will here in after be referred to as "press-clamping position deviation") in a direction perpendicular to the axis of the wire, it is judged that this terminal is a defective product.

During the examination, the degree of processing of the conductor is calculated from the following formula, using the above cross-sectional shape, and it is judged whether or not this conductor-processing degree is good.

Conductor-Processing Degree=(area within barrel after press-clamping÷cross-sectional area of conductor before press-clamping)×100(%)

In the first examination technique, however, the press-deformed barrel portion 2 of the press-clamping terminal 1 is cut, and whether or not the press-clamped condition is good is judged by observing its cross-sectional shape. And, the conductor-processing degree is examined by measuring the area within the barrel. Therefore, the first examination technique may encounter a problem that much time and labor have been required for the examination.

Next, the other examination techniques of the related art will be described.

FIG. 4 shows the other press-clamping terminals formed from a metal sheet. The plurality of press-clamping terminals 100 of a predetermined shape are formed from one metal sheet by a pressing machine (not shown) in such a manner that these terminals 100 are interconnected by a connecting plate 70, each of the press-clamping terminals 100 having a barrel 200 for press-clamping a sheathed wire in connecting relation thereto. The barrel 200 includes a pair of side piece portions 40*a* and 40*b* formed on and extending generally upright respectively from opposite side edges of a bottom portion 30 of the press-clamping terminal 100, and the barrel 200, before press-clamping the sheathed wire, has a generally U-shaped cross-section. In FIG. 4, reference numeral 90 denotes an electrical connection portion for connection to a mating terminal.

The press-clamping terminal 100 is arranged in such a manner that the bottom portion 30 of the barrel 200 is set on an anvil of a pressing apparatus, and then the sheathed wire is inserted into the barrel to be disposed on the inner surface of the bottom portion 30 in the longitudinal direction. Then, a crimper of the pressing apparatus is moved downward to curve the two side piece portions 40*a* and 40*b* of the barrel 200 inwardly in such a manner that the side piece portions 40*a* and 40*b* are opposed to the bottom portion 30, and as a result the bottom portion 30 and the side piece portions 40*a* and 40*b* press-clamp a conductor portion 80*a* of the sheathed wire 80 in an embracing manner, as shown in FIG. 5.

In this case, the sheathed wire 80 is press-clamped in such a manner that the conductor portion 80*a* slightly projects from a distal end of the barrel 200 as shown in FIG. 6, and bell mouths 50, which produce a locking effect as a result of expansion of the conductor portion 80*a*, are formed on the barrel 200. As shown in FIG. 7, serrations 60, each defined by a groove or notch of a channel-shaped cross-section, are formed in the inner surface of the bottom portion 30 of the barrel 200, and the conductor portion 80*a* is firmly held by this serrated portion. The bell mouths 50 and the serrations 60 serve to prevent the sheathed wire 80 from being withdrawn from the press-deformed terminal.

After the press-clamping terminal 100 is press-deformed, a press-clamped condition of the terminal is examined.

In a second examination technique, judgment is made by observing the appearance of the terminal.

However, the second examination technique may encounter the following problem. In the second technique, the press-clamped condition is judged by observing the appearance with the eyes, and therefore this judgment is liable to be subjective, and therefore there has been encountered a problem that the judgment differs from one inspector to another.

In a third technique, dimensions a and b of the bell mouths 50, formed respectively at the opposite ends of the barrel 200, are measured, and an abutment deviation of the crimper is judged from these measured values. At this time, in some cases, the cross-section is observed in order to confirm the positional relation between the serrations 60 and the press-clamped conductor portion 80*a*, as shown in FIG. 7.

However, the third examination technique may encounter the following problem. In the third technique, the judgment is made by measuring the dimensions a and b of the bell mouths 50, and therefore there has been encountered a problem that much labor and time are required for the examination. In the case of observing the cross-section of the serrations 60 in addition, there has been encountered a problem that more time and labor are required for the examination.

SUMMARY OF THE INVENTION

With the above problems in view, it is an object of the present invention to provide a press-clamping terminal and a method of examining the press-clamped condition of the terminal, in which a press-deformed condition can be easily examined without the need for cutting a barrel, and the examination of the press-clamped condition can be carried out effectively. Furthermore, it is another object of the present invention to provide a press-clamping terminal in which an examination can be effected quite easily, and a press-clamped condition can be accurately examined without the need for using a bulky apparatus and tools.

To achieve the above objects, according to a first aspect of the present invention, there is provided a press-clamping terminal which comprises a barrel including a bottom portion, and a pair of side piece portions, which are respectively extended from opposite side portions of the bottom portion, and between which a wire is clamped when the barrel is press-deformed; and at least one examination mark, which is deformed upon press-deforming of the barrel, formed on an outer surface of one of the bottom portion and each of the pair of side piece portions.

In accordance with the first aspect of the present invention, the examination mark, which can be deformed upon press-deforming of the barrel, is formed on the outer surface of the bottom portion or other portion. Therefore, in the examination, when the barrel is viewed from the outside thereof, the position of the mark is deviated toward either of the right and left side piece portions in accordance with the degree of press-deforming of the side piece portions, and therefore on the basis of this deviation, it can be judged whether or not either of the two side piece portions is subjected to a press-clamping position deviation. Further, the mark after the press-clamping operation is observed or measured, and the conductor-processing degree can be judged from the degree of deformation of the mark.

Therefore, by confirming the position of the mark formed on the bottom portion, the degree of deviation of the press-clamping position of the two side piece portions can be judged. And besides, by observing or measuring the size of the deformed mark, the conductor-processing degree can be judged. Therefore, it is not necessary to cut the barrel as in the technique of the related art, and the examination can be easily conducted.

Further, to achieve the above objects, according to a second aspect of the present invention, there is provided a press-clamping terminal which comprises a barrel including a bottom portion, and a pair of side piece portions, which are respectively extended from opposite side portions of the bottom portion, and between which a wire is clamped when the barrel is press-deformed; and at least one examination mark, which is deformed upon press-deforming of the barrel, stamped in an outer surface of one of the bottom portion and each of the pair of side piece portions.

In accordance with the second aspect of the present invention, since the mark is stamped in the outer surface of the bottom portion or the outer surface of the side piece portion, the mark can be formed simultaneously with the shaping of the barrel, and besides the mark will not be lost when the barrel is press-deformed, so that the bottom portion or other portion is extended, and therefore the judgment can be made positively.

According to a third aspect of the present invention, it is preferable that the examination mark has a shape symmetrical with respect to a central portion of the outer surface of one of the bottom portion and each of the pair of side piece portions.

In accordance with the third aspect of the present invention, the mark is symmetrical with respect to the axis in such a manner that its central portion coincides with the center of the bottom portion. In this case, when the mark is deviated upon press-deforming of the barrel, this deviation can be clearly confirmed with the eyes.

Further, to achieve the above objects, according to a fourth aspect of the present invention, there is provided a method of examining press-clamped condition of a press-clamping terminal including a barrel having a bottom portion and a pair of side piece portions, which are respectively extended from opposite side portions of the bottom portion, and between which a wire is clamped when the barrel is press-deformed, wherein after press-deforming the barrel to connect with the wire, press-clamped condition of the pair of side piece portions is examined. The method comprises forming an examination mark on one of the bottom portion and each of the side piece portions of the barrel in advance to press-deforming the barrel; judging a conductor processing degree of the wire on the basis of deformation of the examination mark developing upon clamping the wire; and judging a deviation degree of a press-clamping position on the pair of side piece portions in a direction perpendicular to an axis of the wire on the basis of a position of the examination mark which has been deformed.

In accordance with the fourth aspect of the present invention, in the examination, merely by observing the bottom portion of the barrel just from below the outside, the conductor-processing degree and the press-clamping position deviation of the side piece portions can be examined positively and easily.

Further, to achieve the above objects, according to a fifth aspect of the present invention, there is provided a press-clamping terminal which comprises a barrel including a bottom portion, and a pair of side piece portions, which are respectively extended from opposite side portions of the bottom portion, and between which a wire is clamped when the barrel is press-deformed; a plurality of serrations formed in an inner surface of the bottom portion of the barrel; and a plurality of grooves formed in an outer surface of the bottom portion of the barrel correspondingly to the serrations in the inner surface of the bottom portion so as to indicate positions of the serrations.

In accordance with the fifth aspect of the present invention, the respective positions of the serrations can be easily recognized from the outside of the barrel.

Further, to achieve the above objects, according to a sixth aspect of the present invention, there is provided a press-clamping terminal which comprises a barrel including a bottom portion, and a pair of side piece portions, which are respectively extended from opposite side portions of the bottom portion, and between which a wire is clamped when the barrel is press-deformed; a plurality of serrations formed in an inner surface of the bottom portion of the barrel; a plurality of grooves formed in an outer surface of the bottom portion of the barrel correspondingly to the serrations in the inner surface of the bottom portion so as to indicate positions of the serrations; and a plurality of scales, across which the grooves are respectively extended, formed on the outer surface of the bottom portion.

In accordance with the sixth aspect of the present invention, since the scales are formed, the scales can be observed from any angle, and the press-clamped condition of the barrel can be immediately confirmed.

Further, to achieve the above objects, according to a seventh aspect of the present invention, there is provided a press-clamping terminal which comprises a barrel including a bottom portion, and a pair of side piece portions, which are respectively extended from opposite side portions of the bottom portion, and between which a wire is clamped when the barrel is press-deformed; a plurality of serrations formed in an inner surface of the bottom portion of the barrel; a plurality of grooves formed in an outer surface of the bottom portion of the barrel correspondingly to the serrations in the inner surface of the bottom portion so as to indicate positions of the serrations; and a mark, across which the grooves are respectively extended, formed on the outer surface of the bottom portion.

In accordance with the seventh aspect of the present invention, for example, the mark is deformed in accordance with the press-clamped condition of the terminal, and therefore by observing the positional relation between this deformed portion and the grooves similar in shape to the serrations, it can be judged whether or not the press-clamped condition, determined by the positional relation between the press-clamping terminal and a conductor portion of the sheathed wire, is good.

Further, to achieve the above objects, according to an eighth aspect of the present invention, there is provided a press-clamping terminal which comprises a barrel including a bottom portion, and a pair of side piece portions, which are respectively extended from opposite side portions of the bottom portion, and between which a wire is clamped when the barrel is press-deformed; a plurality of serrations formed in an inner surface of the bottom portion of the barrel; a plurality of grooves, similar in shape to the serrations, stamped in an outer surface of the bottom portion of the barrel correspondingly to the serrations in the inner surface of the bottom portion so as to indicate positions of the serrations; and a mark, across which the grooves are respectively extended, stamped in the outer surface of the bottom portion.

In accordance with the eighth aspect of the present invention, for example, the grooves and the mark are stamped in the outer surface by a pressing machine or the like. In this case, the grooves and the mark can be formed simultaneously with the shaping of the barrel, and besides they will not be lost when the barrel is press-deformed.

According to a ninth aspect of the present invention, the mark may have a frame-like shape.

BRIEF DESCRIPTION OF THE DRAWINGS

The above and other objects and advantages of the present invention will become more apparent by describing in detail preferred embodiments thereof with reference to the accompanying drawings, wherein:

FIGS. 3A and 3B are a cross-sectional view of the press-clamping terminal press-deformed by the technique of the related art, FIG. 3A showing a right deviation of the press-clamping position while FIG. 3B shows a left deviation of the press-clamping position;

FIGS. 17A and 17B are a bottom view of the press-clamping terminal for judging a deviation of the mark, FIG. 17A showing a good product while FIG. 17B shows a defective product;

FIGS. 18A and 18B are a bottom view of the press-clamping terminal for judging a deviation of the mark, FIG. 18A showing a good product while FIG. 18B shows a defective product;

DETAILED DESCRIPTION OF THE PREFERRED EMBODIMENTS

A first embodiment of a press-clamping terminal of the present invention, as well as a method of examining the press-clamped condition of the terminal, now will be described in detail with reference to FIGS. 8A to 21.

Figure 1:
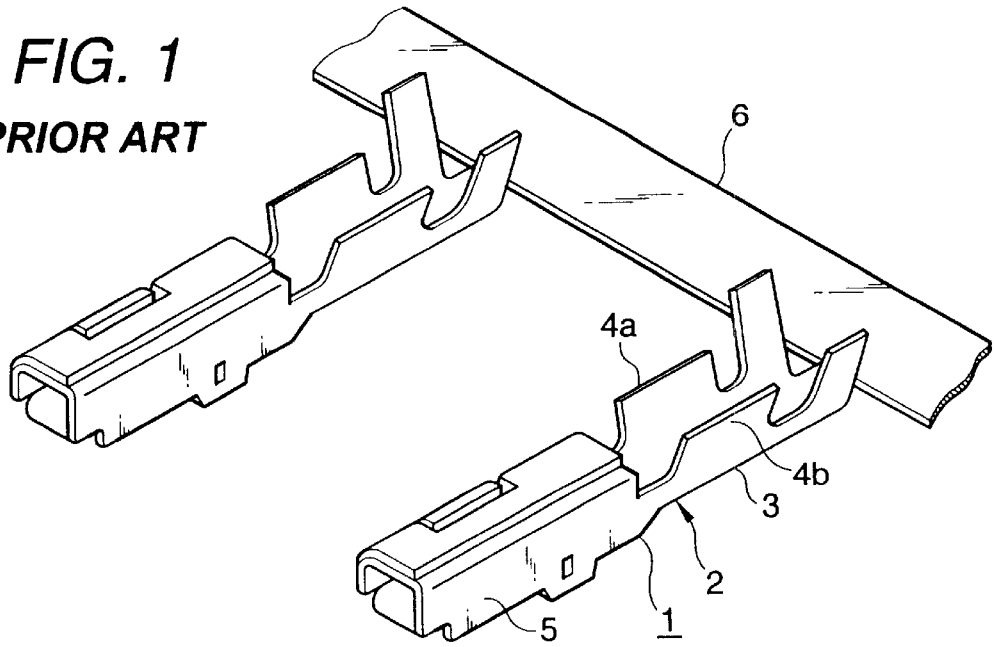
FIG. 1 PRIOR ART
FIG. 1 is a perspective view explanatory of the production of press-clamping terminals.
Figure 2:
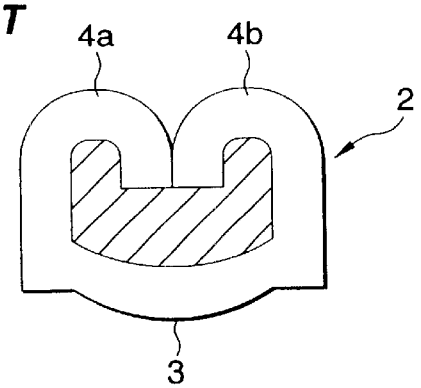
FIG. 2 PRIOR ART
FIG. 2 is a cross-sectional view of the press-clamping terminal pressed deformed by a technique of the related art.
Figure 3A:
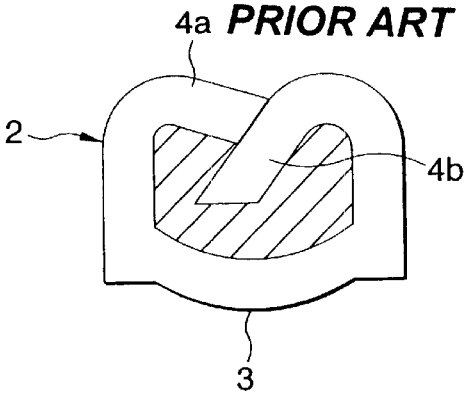
FIG. 3A PRIOR ART
Figure 3B:
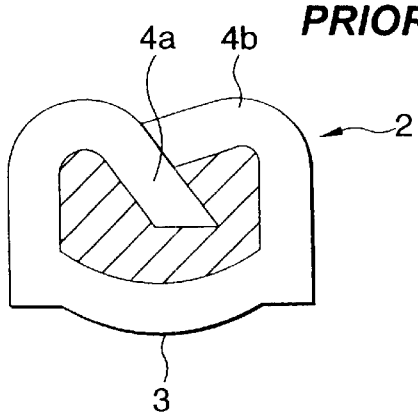
FIG. 3B PRIOR ART
Figure 4:
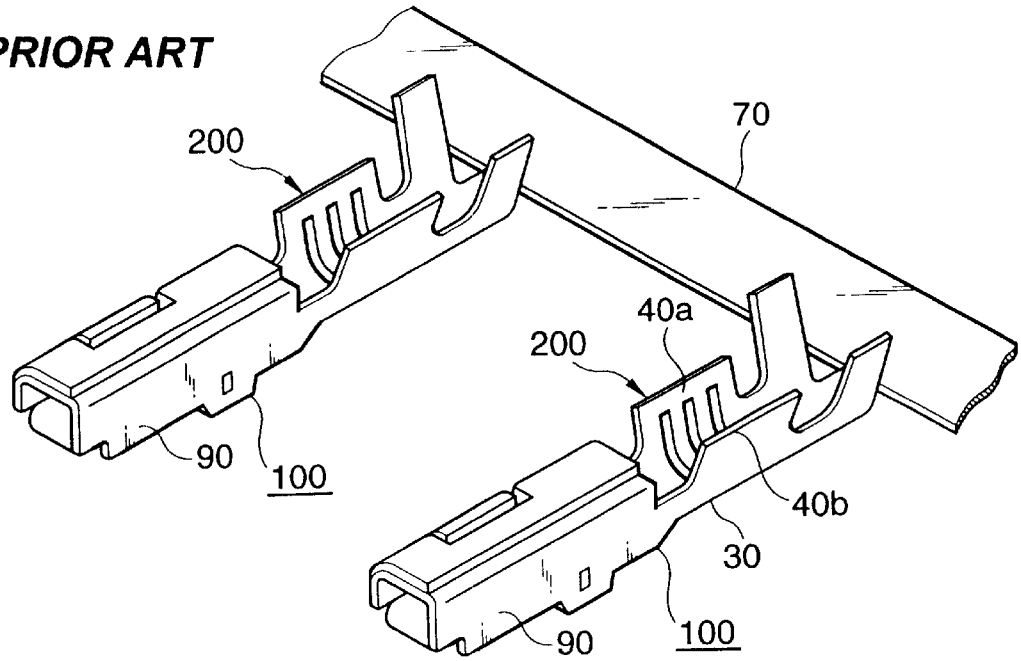
FIG. 4 PRIOR ART
FIG. 4 is a perspective view explanatory of the production of other press-clamping terminals.
Figure 5:
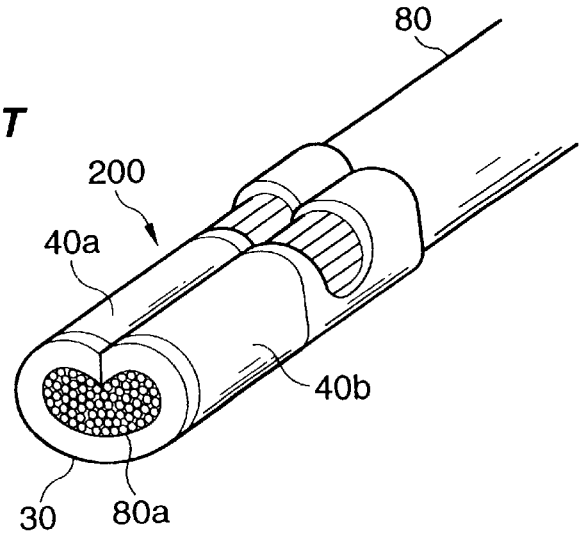
FIG. 5 PRIOR ART
FIG. 5 is a perspective view showing the appearance of a press-connecting terminal in use.
Figure 6:
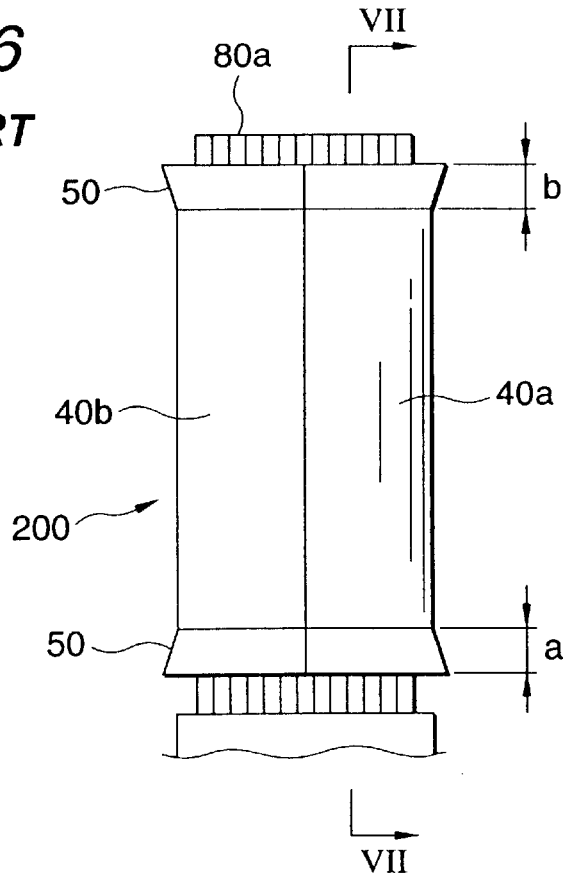
FIG. 6 PRIOR ART
FIG. 6 is a plan view showing a barrel of the press-clamping terminal of FIG. 5.
Figure 7:
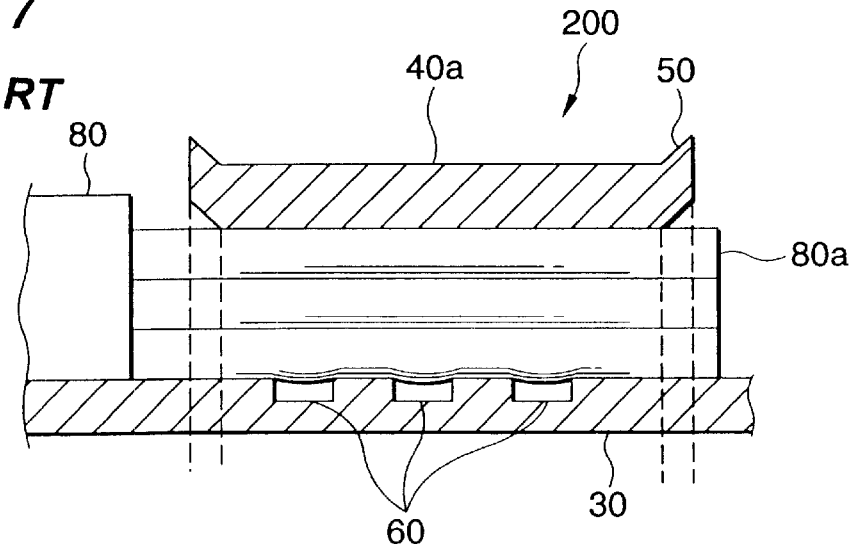
FIG. 7 PRIOR ART
FIG. 7 is a cross-sectional view taken along the line VII–VII of FIG. 6.
Figure 8A:
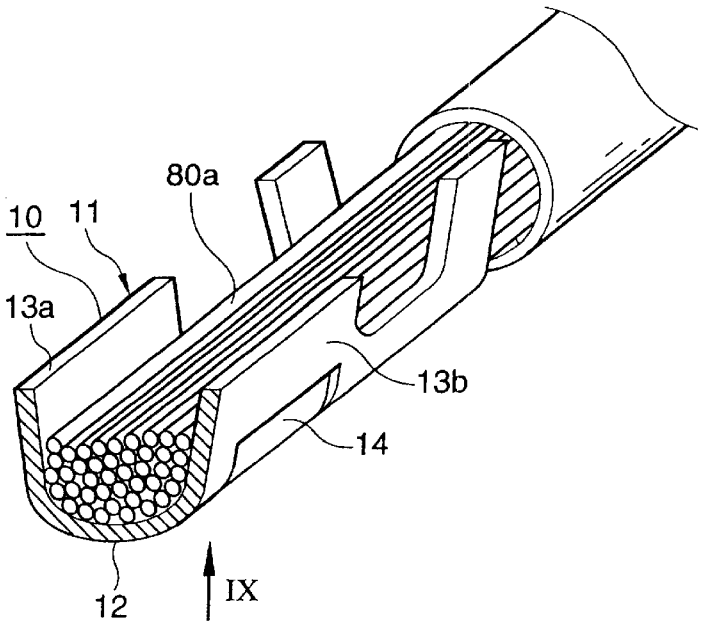
FIGS. 8A and 8B are perspective views showing an important portion of a preferred first embodiment of a press-clamping terminal of the present invention.
Figure 8B:
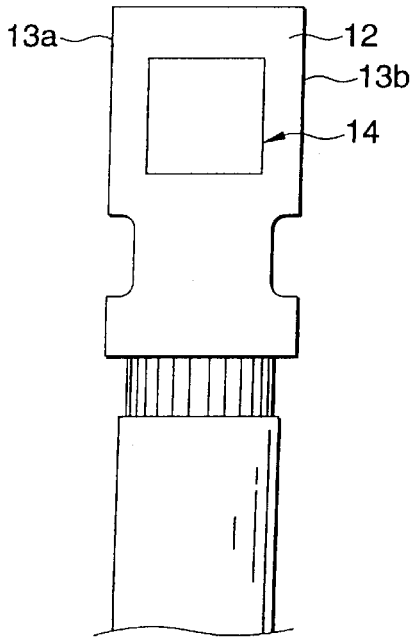

As shown in FIG. 8A, the press-clamping terminal 10 of the first embodiment includes a barrel 11 for press-clamping a conductor portion 80*a* of a sheathed wire, the barrel 11 being formed by a bottom portion 12 and side piece portions 13*a* and 13*b* formed respectively at opposite side edges of the bottom portion 12. This construction is almost similar to the construction discussed in the related art. In the first embodiment, only the barrel 11, forming an important feature of the present invention, is shown, an d the showing of an electrical connection portion is omitted.

A press-clamping examination-purpose mark 14 is impressed on or stamped in an outer surface of the bottom portion 12 of the barrel 11.

Figure 9:
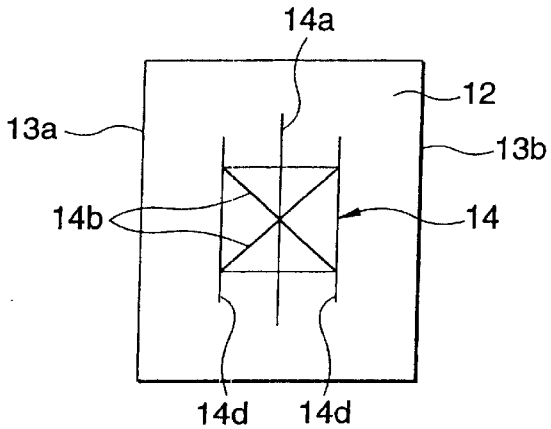
FIG. 9 is a bottom view of the press-clamping terminal as seen in a direction IX of FIG. 8A.

As shown in FIG. 9, this mark 14, when viewed just from below the outer surface of the bottom portion 12, assumes a square frame-like shape having a center line 14*a* and diagonals 14*b*. In this case, the mark 14 is formed such that the center line 14*a* coincides with the axis of the terminal at the outer surface of the bottom portion 12, and this mark further has lines 14*d* parallel to the center line 14*a*. Although the mark 14 is formed on the bottom portion 12, this mark may be formed on other portion (for example, the side piece portion) in so far as the mark is deformed upon press-deforming of the barrel. The mark is not limited to the above square frame-like shape, but may have any other suitable shape in so far as the mark is symmetrical with respect to the center line of the terminal. It is necessary that the mark should not be lost by the press-deforming operation, and therefore in the first embodiment, the mark is impressed or stamped by a pressing machine or the like.

Figure 10:
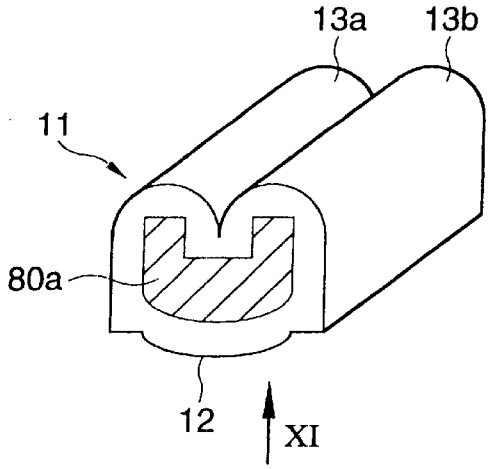
FIG. 10 is a cross-sectional, perspective view of a barrel of the press-clamping terminal of FIG. 8A in a press-deformed condition.
Figure 11:
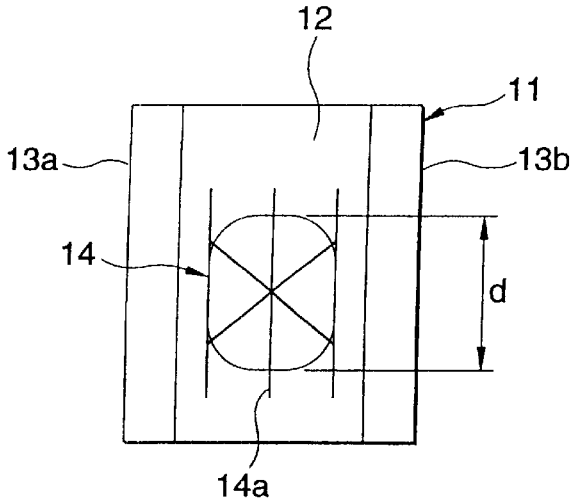
FIG. 11 is a bottom view of the press-clamping terminal as seen in a direction XI of FIG. 10.

The conductor portion 80*a* of the sheathed wire is placed on the barrel 11, and in this condition when the press-deforming operation is effected by a pressing apparatus (not shown) as shown in FIG. 10, the bottom portion 12 and the side piece portions 13*a* and 13*b* are extended in a predetermined direction, so that the mark 14 on the bottom portion 12 is subjected to deformation as shown in FIG. 11. Then, the degree of processing of the conductor and a press-clamping position deviation of the side piece portions 13*a* and 13*b* are judged through observation of the thus deformed mark 14.

Figure 12:
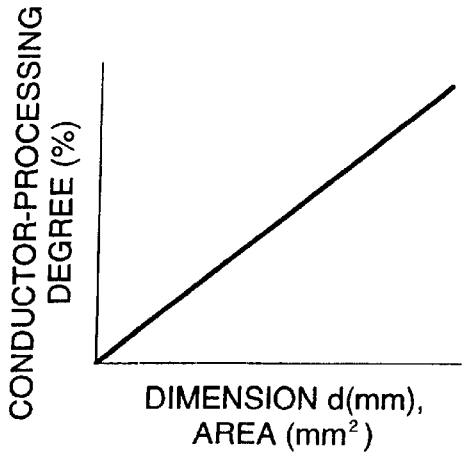
FIG. 12 is a diagram showing the relation between a conductor-processing degree and a dimension/area of a mark.

When the barrel 11 is press-deformed, for example, a length d of the deformed mark 14 in the direction of the center line thereof is measured. Then, the press-deforming degree is estimated by comparing this measured value with reference values defined by the relation between the conductor-processing degree (%) and the dimension (length) d (mm) or the area ($mm^2$) (which have been beforehand obtained), shown in FIG. 12, and by doing so, the degree of processing of the conductor within the barrel 12 is judged. Generally, as the value of the conductor-processing degree and the value of the dimension d or the value of the area, which are shown in FIG. 12, increase, the processing degree increases, and this is considered to be preferable. However, the excessive press-deforming will cause the deformation of the terminal, and therefore is not desirable. Therefore, observation is made to determine whether or not the measured value is within the predetermined reference value range, and by doing so, it is judged whether or not the conductor-processing degree is good.

Figure 13:
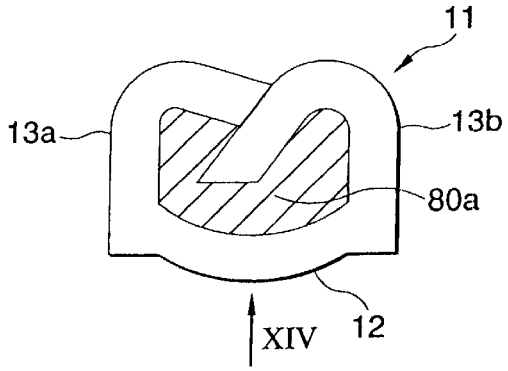
FIG. 13 is a cross-sectional view showing the press-clamping terminal in an improperly press-deformed condition.
Figure 15:
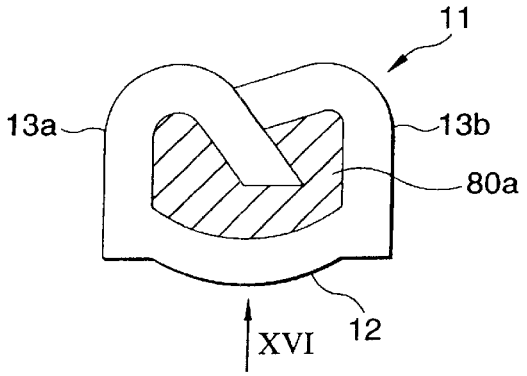
FIG. 15 is a cross-sectional view showing the press-clamping terminal in an improperly press-deformed condition.
Figure 14:
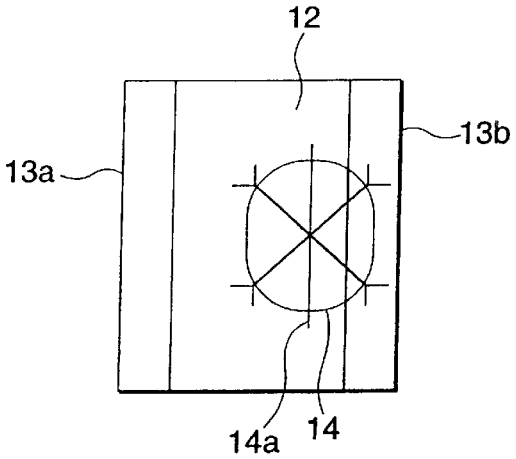
FIG. 14 is a bottom view of the press-clamping terminal as seen in a direction XIV of FIG. 13.
Figure 16:
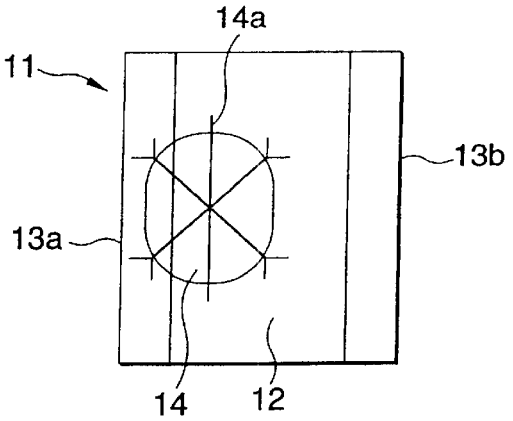
FIG. 16 is a bottom view of the press-clamping terminal as seen in a direction XVI of FIG. 15.

When the press-deforming operation is effected, the position of the mark 14 on the bottom portion 12 is confirmed (for example, it is confirmed through observation whether the mark 14 is disposed in the central position as shown in FIG. 11 or in other position as shown in FIG. 14 or FIG. 16), and a press-clamping position deviation of the two side piece portions 13*a* and 13*b* is judged from this result. More specifically, when the mark 14 is deviated right as shown in FIG. 14, it is judged that the right side piece portion 13*b* has extended into the conductor portion 80*a* as shown in FIG. 13, thus causing "a press-clamping position right-deviation". On the other hand, when the mark 14 is deviated left as shown in FIG. 16, it is judged that the left side piece portion 13*a* has extended into the conductor portion 80*a* as shown in FIG. 15, thus causing "a press-clamping position left-deviation".

Figure 17A:
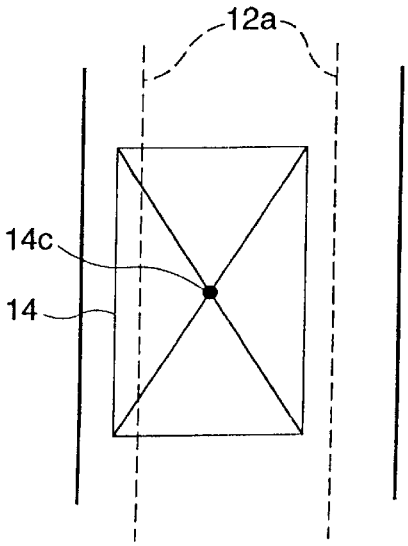
Figure 17B:
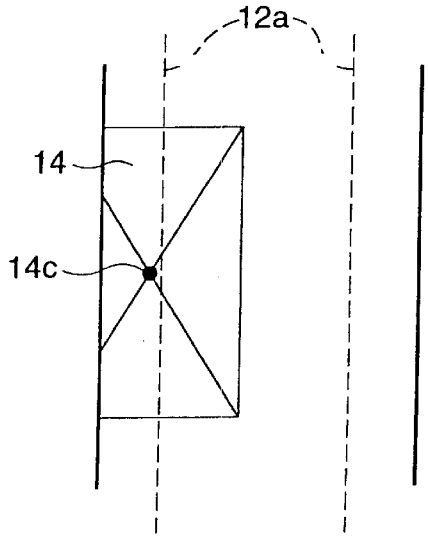
Figure 18A:
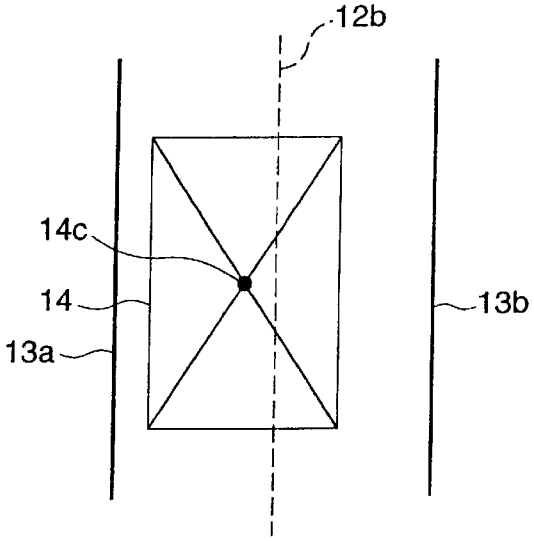
Figure 18B:
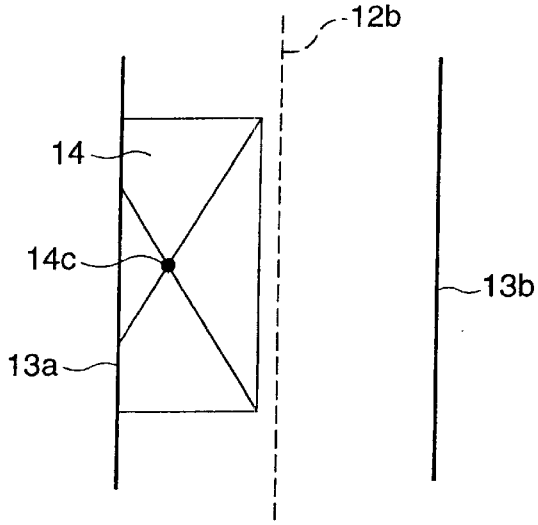

In this case, the judgment is made merely by the eyes. In other method than this, the bottom portion 12 is observed, for example, using a magnifier or a microscope in which an allowable region 12*a* is set, as shown in FIG. 17A. In this case, when the point 14*c* of intersection of the diagonals 14*b* of the mark 14 is disposed within the allowable region 12*a*, it is judged that the terminal is a good product. When the intersection point 14*c* is outside the allowable region 12*a* as shown in FIG. 17B, it is judged that the terminal is a defective product. As another alternative, a reference line 12*b* is set as shown in FIG. 18A, and when the distance between the reference line 12*b* and the intersection point 14*c* of the mark 14 is small, it is judged that the terminal is a good product. When the distance between the reference line 12*b* and the intersection point 14*c* is large as shown in FIG. 18B, it is judged that the terminal is a defective product.

Therefore the mark 14 serves as the criterion for judging the conductor-processing degree at the time of the press-clamping examination of the press-clamping terminal 10, and also serves as the criterion for judging the degree of deviation of the press-clamping position of the two side piece portions 13*a* and 13*b*.

The press-clamping terminal 10 is arranged in such a manner that the bottom portion 12 of the barrel 11 of a generally U-shaped cross-section is set on an anvil (not shown), and then the conductor portion 80*a* of the sheathed wire is inserted into the barrel to be disposed on the inner surface of the bottom portion 12 in the longitudinal direction. Then, a crimper of a pressing apparatus is moved downward to curve the two side piece portions 13*a* and 13*b* of the barrel 11 inwardly in such a manner that these side piece portions 13*a* and 13*b* are opposed to the bottom portion 12, and press-clamp the conductor portion 80*a* of the sheathed wire in an embracing manner. As a result, the mark 14, formed on the bottom portion 12, is deformed.

Thereafter, the press-clamped condition of the press-clamping terminal 10 is examined, and this examination is carried out by observing the bottom portion 12 of the barrel 11.

More specifically, if the mark 14, when viewed just from below the outer surface of the bottom portion 12 of the barrel 11, is disposed generally at the central portion of the bottom portion 12 as shown in FIG. 11, the two side piece portions 13*a* and 13*b*, press-clamping the conductor portion 80*a*, are disposed symmetrically as shown in FIG. 10, and therefore in this case, it is judged that either of the two side piece portions 13*a* and 13*b* is not subjected to a press-clamping position deviation.

On the other hand, if the mark 14 is deviated right as shown in FIG. 14, the right side piece portion 13*b* extends into the conductor portion 80*a* as shown in FIG. 13. If the mark 14 is deviated left as shown in FIG. 16, the left side piece portion 13*a* extends into the conductor portion 80*a*. In such case, it is judged that one of the side piece portions is subjected to a press-clamping position deviation.

In the above examination, the dimension (length) d of the deformed mark 14 is measured, and the press-deforming degree is confirmed by comparing this measured value with the reference values defined by the relation between the conductor-processing degree and the dimension (length) or the area, shown in FIG. 12, and by doing so, the conductor-processing degree can be judged.

Therefore, by observing the mark 14 formed on the bottom portion 12, the degree of deviation of the press-clamping position of the two side piece portions 13*a* and 13*b* can be judged. And besides, the dimension d of the deformed mark 14 is measured, and by comparing this measured value, the conductor-processing degree can be judged. Therefore, the press-clamped condition of the press-clamping terminal 10 can be easily examined.

In the case where the mark 14 is impressed on or stamped in the outer surface of the bottom portion 12 by a pressing machine or the like, this mark can be formed simultaneously with the shaping of the barrel 11, and besides this mark will not be lost when the barrel is press-deformed by a pressing apparatus for press-deforming purposes, and therefore the examination can be positively carried out, and this is advantageous from a practical point of view.

Furthermore, the shape of the mark 14, formed on the bottom portion 12, is symmetrical with respect to the center line in the longitudinal direction, and therefore when the mark 14 is deviated upon press-deforming of the barrel, this deviation can be clearly confirmed with the eyes.

Figure 19A:
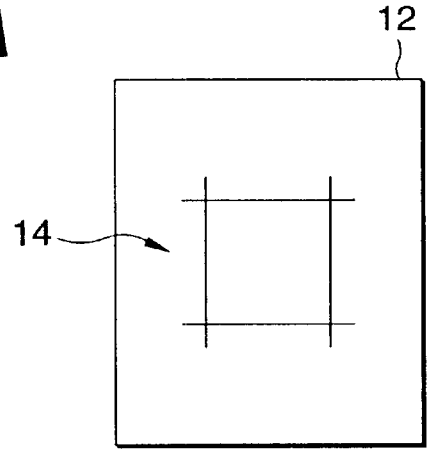
FIGS. 19A to 19C show modified marks, respectively.
Figure 19B:
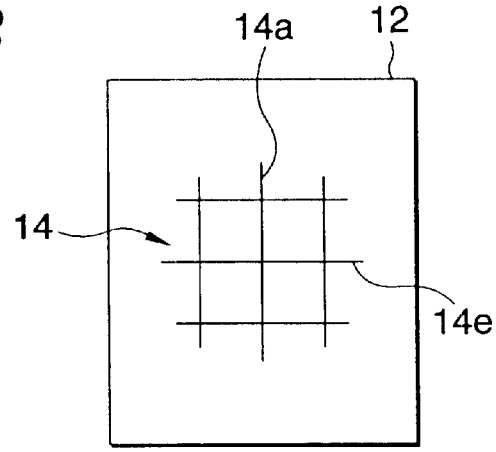
Figure 19C:
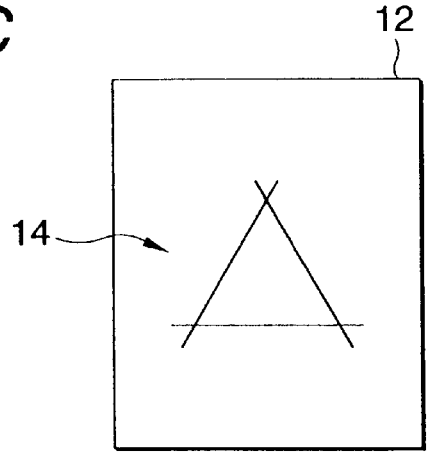

FIGS. 19A to 19C show modified examples of the mark 14, respectively.

A mark 14, shown in FIG. 19A, is formed on the bottom portion 12 of the barrel 11, and has a square frame-like shape having no center line.

A mark 14, shown in FIG. 19B, has a square frame-like shape having a first center line 14*a*, extending in a longitudinal direction of the bottom portion 12, and a second center line 14*b* perpendicular to the first center line 14*a*.

A mark 14, shown in FIG. 19C, is formed on the bottom portion 12 of the barrel 11, and has a triangular frame-like shape having no center line.

Effects, similar to those of the first embodiment, can be obtained with the marks 14 of FIGS. 19A, 19B and 19C.

Figure 20:
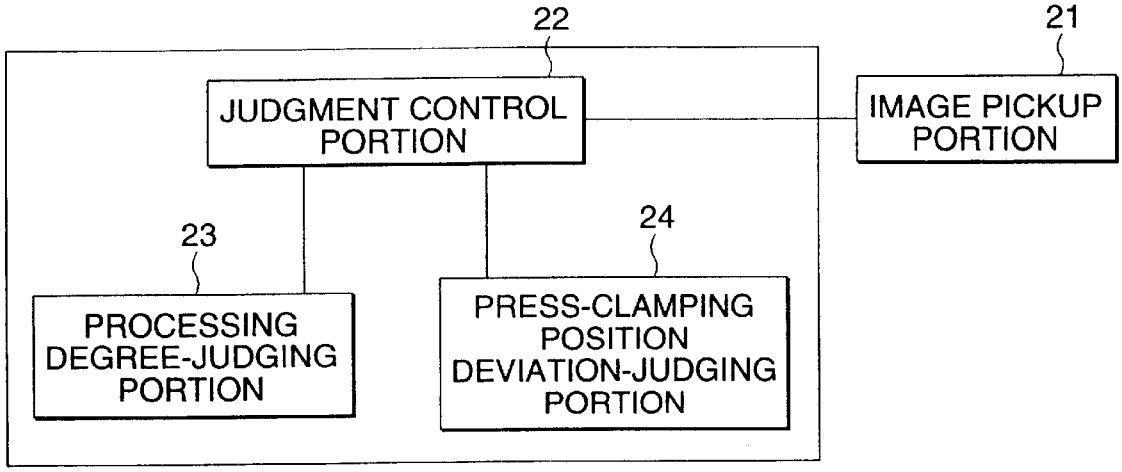
FIG. 20 is a block diagram showing the construction an automatic examination apparatus.
Figure 21:
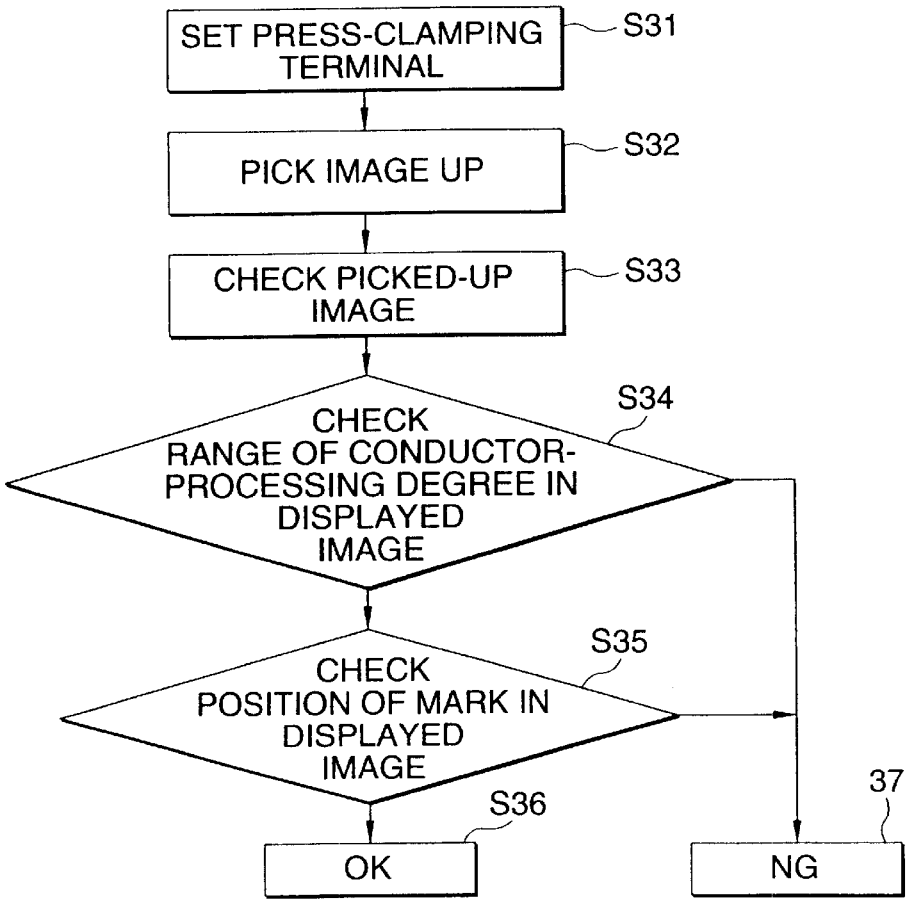
FIG. 21 is a flow chart showing the process of examination by the automatic examination apparatus.

In the first embodiment, although the judgment is made by visual confirmation, the judgment can be automatically made by an image recognition technique as shown in FIGS. 20 and 21. The automatic examination, described below, is applied to press-clamping terminals having the mark 14 shown in FIGS. 8A to 16.

As shown in FIG. 20, in this embodiment, an automatic examination apparatus comprises an image pickup portion (e.g. a CCD camera) 21 for picking up an image of the outer surface of the bottom portion 12 of the barrel 11, a processing degree-judging portion 23 for judging the conductor-processing degree on the basis of pickup-image data fed from the image pickup portion 21, a press-clamping position deviation-judging portion 24 for examining a press-clamping position deviation of the two side piece portions 13*a* and 13*b* on the basis of the position of the mark 14, and a judgment control portion 22 for controlling the judging portions 23 and 24.

As shown in FIG. 21, in this automatic examination apparatus, the press-deformed press-clamping terminal 10 is set in a predetermined examination position in an examination station (S31), and then an image of the bottom portion 12 of the barrel 11 is picked up by the image pickup portion 21 (S32). Then, the examination is effected on the basis of data, representing the picked-up image, by the judgment control portion 22 (S33).

In this case, when the pickup-image data is fed from the image pickup portion 21, the processing degree-judging portion 23 compares the dimension (length) d of the deformed mark 14 with the predetermined reference values, and judges the conductor-processing degree (S34). As a result, if the conductor-processing degree is within a predetermined range, the process proceeds to the next Process Step S35. In contrast, if the conductor-processing degree is outside the predetermined range, it is decided that the terminal is no good, i.e., NG (S37), and the judgment control portion 22 produces an alarm or the like to stop the apparatus.

In Process Step S35, on the basis of the pickup-image data, the press-clamping position deviation-judging portion 24 compares the position of the mark 14 on the bottom portion 12 with the reference data, and judges a press-clamping position deviation of the two side piece portions 13*a* and 13*b* (S35). As a result, if the press-clamping position deviation is within the allowable range, it is judged that the terminal is a good product (S36). In contrast, if the data indicates that the mark position is deviated right or left from the center, it is judged that the terminal is no good, i.e., NG, that is, a defective product (S37).

Therefore, on the basis of the pickup-image data, the automatic examination apparatus judges the conductor-processing degree, and also judges the press-clamping position deviation of the two side piece portions 13*a* and 13*b*, and therefore the examination can be carried out rapidly.

In the above embodiment, which includes the modifications thereof, although the examination mark 14 is formed on the bottom portion 12 of the barrel 11, such mark may be formed on the two side piece portions 13*a* and 13*b*, in which case similar effects can be achieved. Thus, the present invention is not limited to the illustrated embodiment.

As described above, the examination mark, which can be deformed upon press-deforming of the barrel, is formed on the outer surface of the bottom portion. Therefore, in the examination, a press-clamping position deviation of the two side piece portions and the conductor-processing degree can be judged by observing the mark from the outside of the barrel, and the press-clamped condition of the press-clamping terminal can be easily examined.

The mark is impressed on or stamped in the bottom portion, and therefore the examination can be carried out properly.

The shape of the mark, formed on the bottom portion, is symmetrical with respect to the center line in the longitudinal direction, and therefore when the mark is deviated upon press-deforming of the barrel, this deviation can be clearly confirmed with the eyes.

The conductor-processing degree is judged on the basis of the dimension (length) of the deformed mark, and also a deviation of the press-clamping position of the side piece portions is judged on the basis of the position of this mark. Therefore, merely by observing the barrel just from below the outer surface of the barrel, the conductor-processing degree and the press-clamping position deviation of the side piece portions can be positively examined, and therefore there is obtained the examination method which can be carried out easily and properly.

A second embodiment of a press-clamping terminal of the present invention, as well as a method of examining the press-clamped condition of the terminal, now will described in detail with reference to FIGS. 22 to 27.

Figure 22:
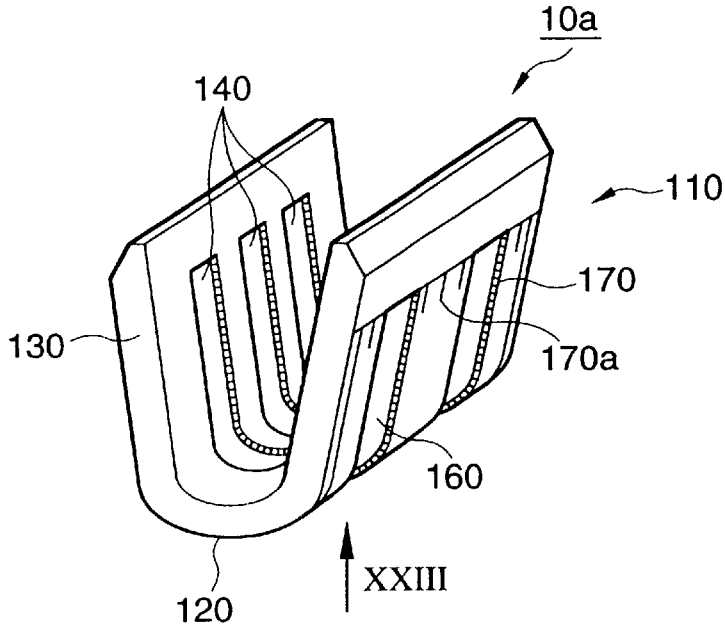
FIG. 22 is an enlarged, perspective view of an important portion of a preferred second embodiment of a press-clamping terminal of the present invention.

As shown in FIG. 22, the press-clamping terminal 10*a* of the present invention includes a barrel 110 for press-clamping a conductor portion 80*a* (see FIGS. 25 and 27) of a sheathed wire 80, the barrel 110 being formed by a bottom portion 120 and side piece portions 130 formed at opposite side edges of the bottom portion 120. In this example, only the barrel 110 of the press-clamping terminal 10*a*, forming an important feature of the present invention, is shown on an enlarged scale, and the showing of an electrical connection portion is omitted.

Figure 25:
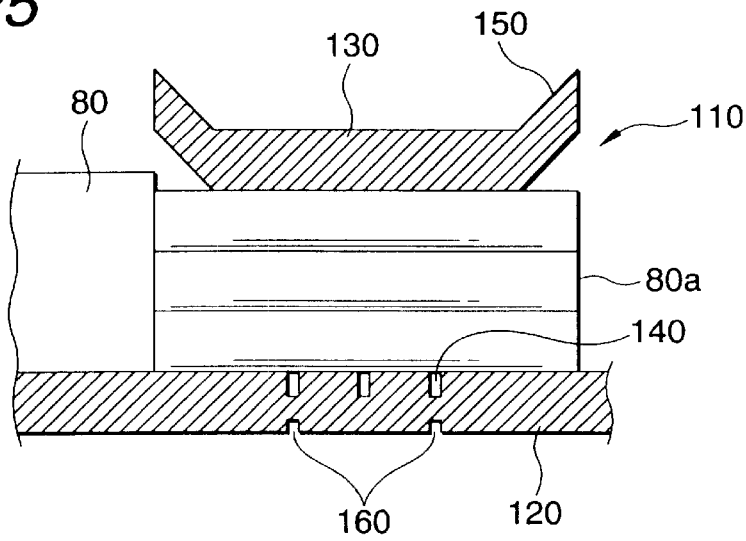
FIG. 25 is a cross-sectional view taken along the line XXV–XXV of FIG. 24, showing the good barrel.

As shown in FIGS. 22 and 25, three serrations 140, each defined by a groove or notch of a channel-shaped cross-section, are formed in an inner surface of the bottom portion 120, and extend in a direction perpendicular to a longitudinal axis of the bottom portion 120. This construction is almost similar to that of the terminal.

Figure 23:
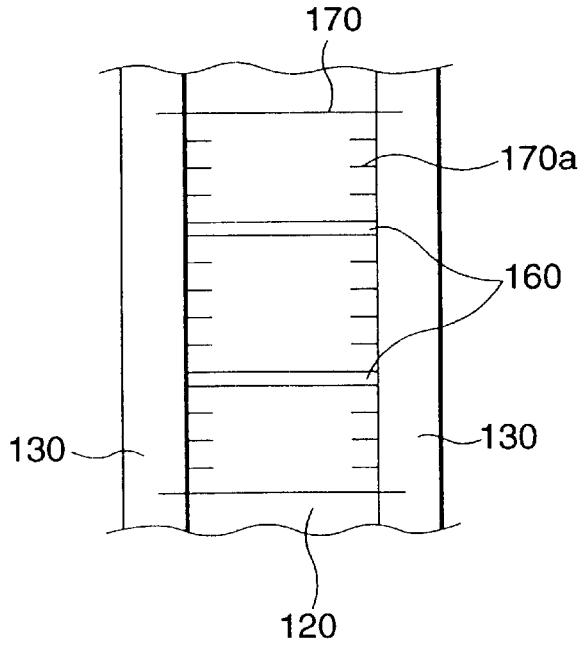
FIG. 23 is a bottom view of a barrel as seen in a direction XXIII of FIG. 22.
Figure 24:
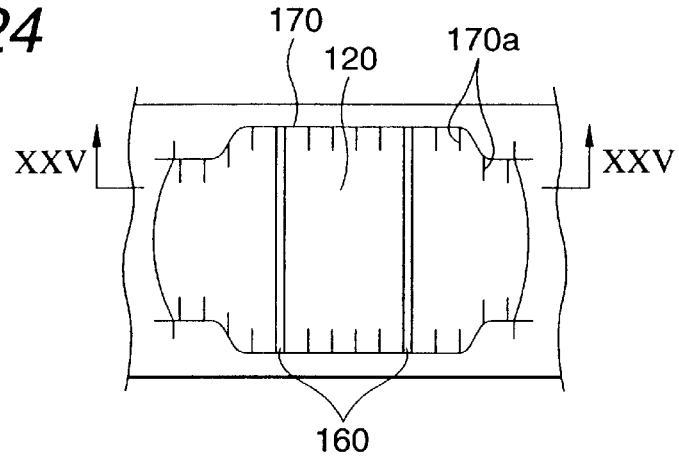
FIG. 24 is a view of a bottom portion of the barrel, showing a good product.

In the second embodiment, serration-indicating grooves 160, having a channel-shape similar to that of the serration 140, are formed in an outer surface of the bottom portion 120, and are disposed in registry with the serrations 140. As shown in FIGS. 23 to 25, the two grooves 160 are formed in the outer surface of the bottom portion 120, and are disposed respectively in registry with two of the three serrations 140 remote from each other.

A frame-like mark 170 is formed on the outer surface of the bottom portion 120, and the two grooves 160 extend across the mark 170, and the mark 170 is symmetrical with respect to the grooves 160.

A scale (or graduations) 170*a* is provided on the mark 170 in the longitudinal direction.

The grooves 160 and the mark 170 are provided SO that the positional relation between the conductor portion of the sheathed wire and the serrations 140 in the barrel 110, as well as the positional relation between the conductor portion and bell mouths 150 (described later), can be confirmed. The grooves 160 and the mark 170 are provided over an area covering the outer surface of the bottom portion 120 and the two side piece portions 130.

The grooves 160 and the mark 170 are impressed on or stamped in the barrel 110 by a pressing machine or the like so that they will not be lost when the barrel 110 is press-deformed.

The press-clamping terminal 10*a* of the above construction is arranged in such a manner that the bottom portion 120 of the barrel 110, having a generally U-shaped cross-section, is set on an anvil (not shown), and then the conductor portion of the sheathed wire is inserted into the barrel to be disposed on the inner surface of the bottom portion 120 in the longitudinal direction. Then, a crimper of a pressing apparatus is moved downward to curve the two side piece portions 130 of the barrel 110 inwardly in such a manner that the side piece portions 130 are opposed to the bottom portion 120, thereby press-clamping the conductor portion 80*a* of the sheathed wire 80 in an embracing manner.

Thereafter, the press-clamped condition of the press-clamping terminal 10*a* is examined, and this examination is carried out through observation of the bottom portion 120 of the barrel 110.

The mark 170 on that portion of the barrel 110, which is press-clamped upon contact of the crimper, is deformed to bulge outwardly when this mark is viewed from the outer side of the bottom portion 120 of the barrel 110. Therefore, for example, as shown in FIG. 24, if the grooves 160 are disposed generally at a central portion of the mark 170, and it can be confirmed by counting the graduations 170*a* that the deformed portion of the mark 170 is disposed in a predetermined position, then it can be judged that the positional relation between the conductor portion 80*a* and the serrations 140 is good as shown in FIG. 25, and that the positions of the bell mouths 150, formed respectively at the opposite ends of the barrel 110, are good.

Figure 26:
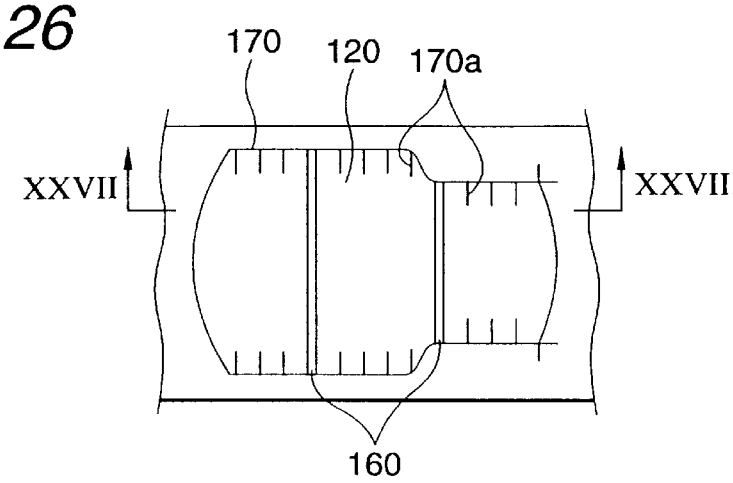
FIG. 26 is a view of the bottom portion of the barrel, showing a defective product.
Figure 27:
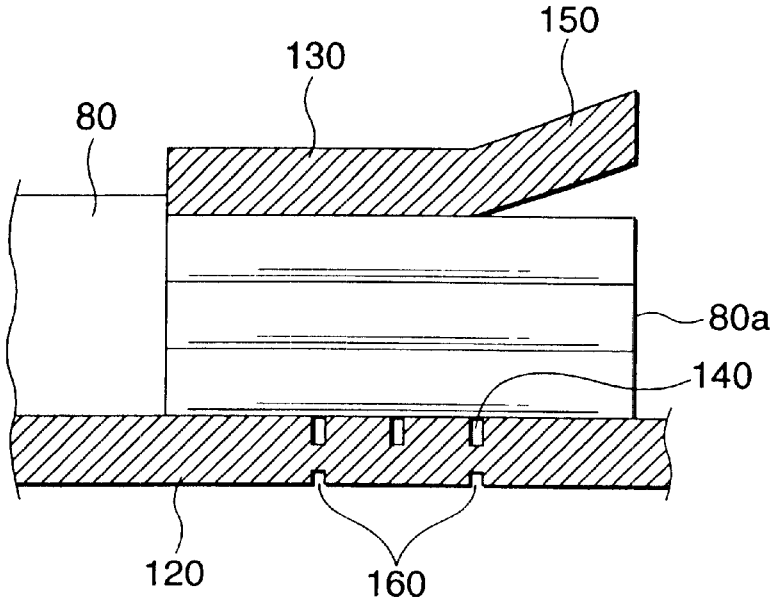
FIG. 27 is a cross-sectional view taken along the line XXVII—XXVII of FIG. 26, showing the defective barrel.

On the other hand, as shown in FIG. 26, if it is confirmed that when the mark 170 is viewed from the outer side of the bottom portion 120 of the barrel 110, part of the mark 170, subjected to the press-clamping operation, is not deformed such that the mark 170 is not disposed in the predetermined position, and is asymmetrical although the grooves 160 are disposed generally at the central portion of the mark 170, then it can be judged that the bell mouth 150 at one end of the barrel is extremely large as shown in FIG. 27, and that with respect to the positional relation between the conductor portion 80*a* and the serrations 140, one of the serrations 140 fails to adequately perform its function, and therefore it is judged that the terminal is a defective product.

Thus, in the second embodiment, there are provided the grooves 160 and the mark 170 which serve as a criterion for confirming the press-clamped condition of the barrel 110 and the positional relation between the conductor portion 80*a* and the serrations 140. Therefore, an examination can be quite easily carried out to determine whether or not the press-clamping terminal is a good product. And besides, the examination can be effected rapidly without the need for using a bulky apparatus and tools.

In the case where the grooves 160 and the mark 170 are impressed on or stamped in the bottom portion 120 by a pressing machine or the like, they can be formed simultaneously with the shaping of the barrel 110, and besides they will not be lost when the barrel is press-deformed by a pressing apparatus for press-deforming purposes. Thus, there is no fear that these marks are lost, and therefore the examination can be positively carried out, and this is advantageous from a practical point of view.

Figure 28:
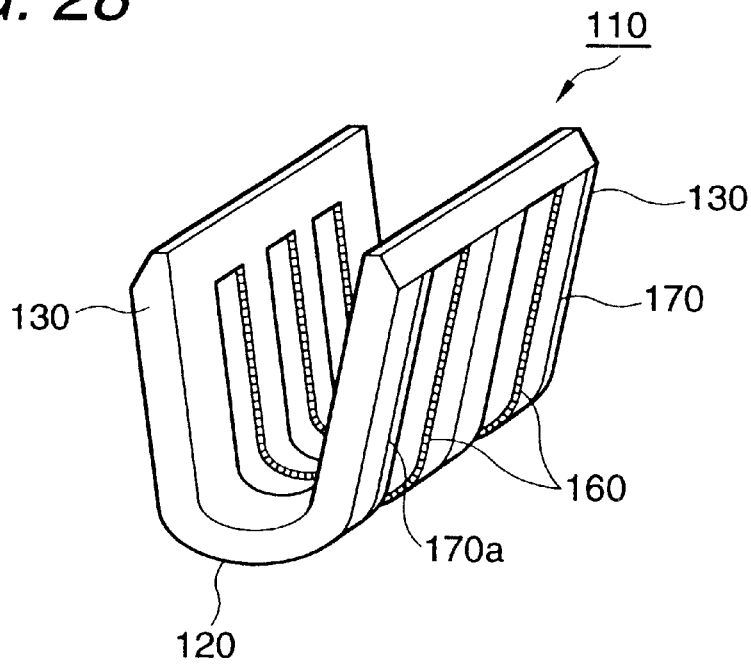
FIG. 28 is an enlarged, perspective view of an important portion of a preferred third embodiment of a press-clamping terminal of the present invention.
Figure 29:
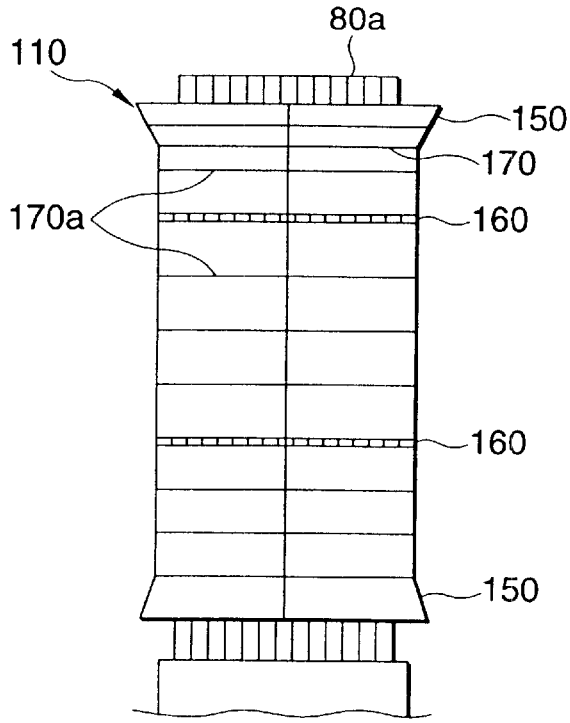
FIG. 29 is a view of a good barrel of FIG. 28 as seen from the top.
Figure 30:
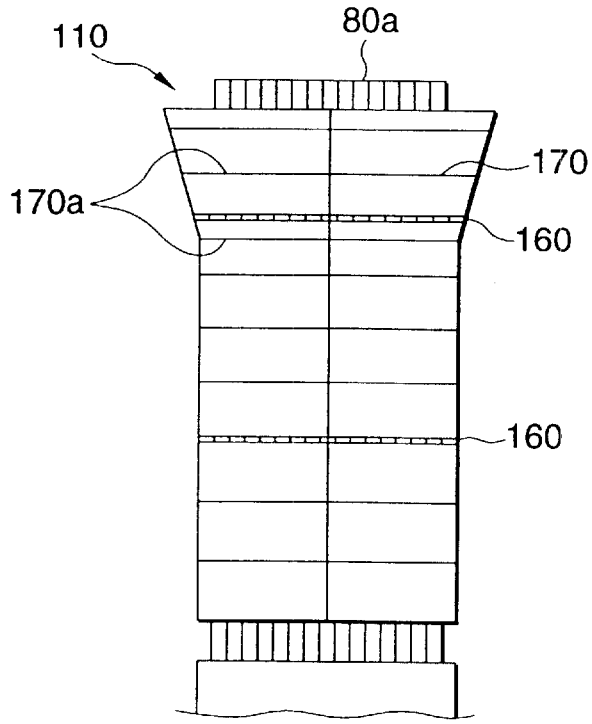
FIG. 30 is a view of a defective barrel of FIG. 28 as seen from the top.

FIGS. 28 to 30 show a third embodiment of a press-clamping terminal of the present invention.

In the third embodiment, grooves 160 and a scale (graduations) 170*a* of a mark 170 as described above for the second embodiment are impressed on or stamped in an outer surface of a bottom portion 120 of a barrel 110 and outer surfaces of opposite side piece portions 130 generally over entire areas thereof.

Thus, the grooves 160 and the scale 170*a* are provided at the barrel 110 generally over the entire area thereof. When the crimper properly contacts the barrel, the final terminal is a good product. In contrast, when the crimper improperly contacts the barrel, the final terminal is a defective product. In both cases, the grooves 160 and the scale 170*a* of the mark 170 can be observed from any angle, and the press-deformed condition of the press-clamping terminal can be immediately confirmed, and basically, effects, similar to those of the second embodiment, be obtained.

As described above, the grooves and the mark for confirming the press-clamped condition are provided at the bottom portion of the barrel, and therefore the examination can be quite easily carried out to determine whether or not the press-clamping terminal is good. And besides, there is no need to use a bulky apparatus and tools, and therefore the examination can be conducted rapidly.

The grooves and the mark are impressed on or stamped in the outer surface of the barrel, and therefore there is no fear that these marks will not be lost during the pressing-clamping operation. Therefore, the examination can be carried out properly, and this is advantageous from a practical point of view.

It is contemplated that numerous modifications may be made to the press-clamping terminal and the method of examining the press-clamped condition of the press-clamping terminal, of the present invention without departing from the spirit and scope of the invention as defined in the following claims.

What is claimed is:

1. A press-clamping terminal, comprising:

a barrel including a bottom portion, and a pair of side piece portions, which are respectively extended from opposite side portions of the bottom portion, and between which a wire is clamped when the barrel is press-deformed; and at least one examination mark, which is deformed upon press-deforming of the barrel, formed on an outer surface of one of either the bottom portion or both of the pair of side piece portions, wherein a degree of press-deforming of the barrel is determined by comparing a measured value of a length of the at least one examination mark along an axis of the wire with a reference value, wherein the examination mark has a width smaller than a width of a corresponding portion of the barrel after the barrel is press-deformed; and wherein the examination mark has a shape symmetrical with respect to a central portion of the outer surface of one of the bottom portion and each of the pair of side piece portions.

2. A press-clamping terminal, comprising:

a barrel including a bottom portion, and a pair of side piece portions, which are respectively extended from opposite side portions of the bottom portion, and between which a wire is clamped when the barrel is press-deformed; and at least one examination mark, which is deformed upon press-deforming of the barrel, stamped in an outer surface of one of either the bottom portion or both of the pair of side piece portions, wherein a degree of press-deforming of the barrel is determined by comparing a measured value of a length of the at least one examination mark along an axis of the wire with a reference value, wherein the examination mark has a width smaller than a width of a corresponding portion of the barrel after the barrel is press-deformed; and wherein the examination mark has a shape symmetrical with respect to a central portion of the outer surface of one of the bottom portion and each of the pair of side piece portions.

3. A method of examining a press-clamped condition of a press-clamping terminal including a barrel having a bottom portion and a pair of side piece portions, which are respectively extended from opposite side portions of the bottom portion and between which a wire is clamped when the barrel is press-deformed, wherein after press-deforming the barrel to connect with the wire, a press-clamped condition of the pair of side piece portions is examined, the method comprising:

forming an examination mark on an outer surface of one of either the bottom portion or both of the pair of side piece portions in advance to press-deforming the barrel, wherein the examination mark has a width smaller than a width of its corresponding portion of the barrel after the barrel is press-deformed;

judging a conductor processing degree of the wire by comparing a measured value of a length of the examination mark along an axis of the wire with a predetermined reference value upon clamping the wire; and judging a deviation degree of a press-clamping position on the pair of side piece portions on the basis of a deviation in a position of the examination mark in a direction perpendicular to the axis of the wire.

4. The method of examining a press-clamped condition of a press-clamping terminal according to claim 3, further comprising:

judging a conductor processing degree of the wire by comparing a measured value of a length of the second examination mark along an axis of the wire with a predetermined reference value upon clamping the wire; and judging a deviation degree of a press-clamping position on the pair of side piece portions on the basis of a deviation in a position of the second examination mark in a direction perpendicular to the axis of the wire.

5. A press-clamping terminal, comprising:

a barrel including a bottom portion, and a pair of side piece portions, which are respectively extended from opposite side portions of the bottom portion, and between which a wire is clamped when the barrel is press-deformed;

a plurality of serrations formed in an inner surface of the bottom portion of the barrel;

a plurality of grooves formed in an outer surface of the bottom portion of the barrel correspondingly to the serrations in the inner surface of the bottom portion so as to indicate positions of the serrations; and a plurality of scales, across which the grooves are respectively extended, formed on the outer surface of the bottom portion.

6. A press-clamping terminal, comprising:

a barrel including a bottom portion, and a pair of side piece portions, which are respectively extended from opposite side portions of the bottom portion, and between which a wire is clamped when the barrel is press-deformed;

a plurality of serrations formed in an inner surface of the bottom portion of the barrel;

a plurality of grooves formed in an outer surface of the bottom portion of the barrel correspondingly to the serrations in the inner surface of the bottom portion so as to indicate positions of the serrations; and a gauge mark, across which the grooves are respectively extended, formed on the outer surface of the bottom portion, wherein a degree of press-deforming of the barrel is determined by comparing a measured value of a length of the gauge mark along an axis of the wire obtained after press-deforming with a predetermined reference value, wherein said gauge mark conforms to predetermined standard dimensions such that it is symmetrical with respect to the grooves.

7. A press-clamping terminal, comprising:

a barrel including a bottom portion, and a pair of side piece portions, which are respectively extended from opposite side portions of the bottom portion, and between which a wire is clamped when the barrel is press-deformed;

a plurality of serrations formed in an inner surface of the bottom portion of the barrel;

a plurality of grooves formed in an outer surface of the bottom portion of the barrel correspondingly to the serrations in the inner surface of the bottom portion so as to indicate positions of the serrations; and a frame-like gauge mark, across which the grooves are respectively extended, formed on the outer surface of the bottom portion, wherein a degree of press-deforming of the barrel is determined by comparing a measured value of a length of the gauge mark along an axis of the wire obtained after press-deforming with a predetermined reference value, wherein said gauge mark conforms to predetermined standard dimensions such that it is symmetrical with respect to the grooves.

8. A press-clamping terminal, comprising:

a barrel including a bottom portion, and a pair of side piece portions, which are respectively extended from opposite side portions of the bottom portion, and between which a wire is clamped when the barrel is press-deformed;

a plurality of serrations formed in an inner surface of the bottom portion of the barrel;

a plurality of grooves, similar in shape to the serrations, stamped in an outer surface of the bottom portion of the barrel correspondingly to the serrations in the inner surface of the bottom portion so as to indicate positions of the serrations; and a gauge mark, across which the grooves are respectively extended, stamped in the outer surface of the bottom portion, wherein a degree of press-deforming of the barrel is determined by comparing a measured value of a length of the gauge mark along an axis of the wire obtained after to press-deforming with a predetermined reference value, wherein said gauge mark conforms to predetermined standard dimensions such that it is symmetrical with respect to the grooves.

9. A method of examining press-clamped condition of a press-clamping terminal including a barrel having a bottom portion and a pair of side piece portions, which are respectively extended from opposite side portions of the bottom portion, and between which a wire is clamped when the barrel is press-deformed, wherein after press-deforming the barrel to connect with the wire, press-clamped condition of the pair of side piece portions is examined, the method comprising:

forming a plurality of serrations in an inner surface of the bottom portion of the barrel;

forming a plurality of groves in an outer surface of the bottom portion of the barrel correspondingly to the serrations in the inner surface of the bottom portion so as to indicate positions of the serrations;

forming a plurality of scales, across which the groves are respectively extended, formed on the outer surface of the bottom portion;

judging a conductor processing degree of the wire by comparing a measured value of a length of the examination mark along an axis of the wire with a reference value upon clamping the wire; and judging a deviation degree of a press-clamping position on the pair of side piece portions on the basis of a deviation in a position of the examination mark in a direction perpendicular to the axis of the wire.

* * * * *